US005199602A

United States Patent [19]

Drew

[11] Patent Number: 5,199,602

[45] Date of Patent: Apr. 6, 1993

[54] FLEXIBLE RETAINER CLOSURE DEVICE

[75] Inventor: Terrence M. Drew, Boulder, Colo.

[73] Assignee: Alden Laboratories, Inc., Boulder, Colo.

[21] Appl. No.: 675,755

[22] Filed: Mar. 27, 1991

[51] Int. Cl.[5] ..... B67B 7/00

[52] U.S. Cl. ..... 222/1; 222/530; 222/538

[58] Field of Search ..... 222/530, 527, 529, 538, 222/1; 239/DIG. 12; 383/70, 71

[56] References Cited

U.S. PATENT DOCUMENTS 1,225,017 5/1917 Decker ..... 222/530
2,744,661 5/1956 Davis ..... 222/189
2,957,614 10/1960 Krajcovic ..... 229/7
3,217,934 11/1965 Schneider et al. ..... 222/107
3,224,640 12/1965 Schneider et al. ..... 222/107
3,392,887 7/1968 Bross ..... 222/530 X
4,243,162 1/1981 Klygis ..... 222/530
5,065,914 11/1991 Chollet ..... 222/530 X

*Primary Examiner*—Gregory L. Huson
*Attorney, Agent, or Firm*—Sheridan, Ross & McIntosh

[57] ABSTRACT

A closure device (10) for closing a flexible retainer (12) holding a flowable material (14) is provided. The retainer (12) comprises a body (18) for retaining the flowable material (14), a sealed slit (26), an opening (24), a neck (20) and mouth (22) between the body (18) and open end (24). The device (10) is closed, thereby substantially preventing flow of the material (14) therethrough, when the neck (20) is folded about a channel (30) and the opening (24) is inserted through the slit (26).

23 Claims, 2 Drawing Sheets

FLEXIBLE RETAINER CLOSURE DEVICE

TECHNICAL FIELD OF THE INVENTION

This invention relates in general to devices for closing retainers and in particular to a device for closing a flexible retainer holding a flowable material.

BACKGROUND OF THE INVENTION

Flowable material retainers, including containers or conduits, formed from flexible sheet materials have found or are adaptable to a broad range of applications. For example, such retainers may be employed as plasma bags, colostomy bags, fluid conduits, or packages for storing flowable materials, e.g., fluids, powders, or semi-fluid materials. Retainers formed from flexible materials have proved popular in part because they are relatively simple and inexpensive to produce, particularly if formed from sheet materials which can be heat sealed together to form a retainer body, and are deformable to facilitate storage or deployment of the retainer in compact or irregularly shaped areas.

In many applications, it is important that a closure device be provided which is capable of sealably closing the flexible retainer. For example, in the case of plasma bags, a reliable closure must be formed to prevent escape or contamination of the plasma. One method of closing a flexible retainer is by exerting a clamping force on opposing walls of the retainer thereby pressing the walls together to form a closure to inhibit flow of material therebetween. A difficulty encountered in connection with such closure devices is the tendency for the closure to fail when an expansion force is exerted thereon. Such expansion forces are exerted, for example, when the flowable material flows towards the closure urging the opposing walls apart in the vicinity of the closure. Flow towards the closure may result when a compression force is exerted on the retainer, such as when weight is placed on the retainer or the retainer is squeezed, or when the retainer is turned so that material flows towards the closure due to gravitational forces. It is desirable that a closure device be provided wherein the clamping force pressing the opposing walls together increases to counteract expansion forces resulting when material flows towards the closure.

One device for closing a flexible retainer is disclosed in U.S. Pat. No. 3,217,934. Two flexible sheets are sealed together to form walls of a package body and a discharge channel which tapers from the package body to an open end. One of the package walls has a slit therein and a means, such as a flexible strip, is applied to the inner face of the wall to prevent the contents of the package from escaping through the slit. The package is closed by folding the package along a line transverse to the discharge channel and inserting the open end into the slit. Presumably, the container walls are pressed together to form a closure thereby inhibiting passage of the container contents therethrough when the package is closed. However, the patent does not disclose a device whereby the force pressing the walls together increases to counteract increasing expansion forces resulting when material flows towards the closure. In addition, the patent does not disclose a closure device for retaining gases.

Other devices for closing flexible retainers provide a separate piece, such as a lid or clamp, which can be attached to the retainer body thereby closing the retainer. However, such devices have the disadvantage that the separate piece may be lost resulting in inconvenience to the user. In addition, the need for a separate piece increases the expense and difficulty of manufacture.

Also known are closure devices wherein mating elements are provided on opposing walls of the package so that the package may be closed by interlocking the elements, for example, zip-lock bags. However, the provision of such elements increases the difficulty and expense of production. Moreover, such closure devices do not provide a method whereby the forces pressing the opposing walls together increase to counteract expansion forces resulting when material flows towards the closure. In fact, such closure devices are typically reopened in ordinary use by pulling the opposing walls apart to break the closure.

Thus, there is a need for a closure device for closing flexible retainers wherein a clamping force increases to counteract expansion forces exerted on the closure due to material flow towards the closure. Preferably, such a device would be simple and inexpensive to produce yet capable of sealably retaining a broad range of flowable materials.

SUMMARY OF THE INVENTION

In accordance with the present invention a closure device and method for sealably closing a retainer holding flowable material are provided. The closure device provides a means whereby a clamping force increases to counteract expansion forces exerted on a closure by the contents flowing towards the closure. The closure device is simple and inexpensive to produce and is capable of sealably retaining a broad range of flowable materials.

According to one embodiment of the invention, a closure device to close a flexible body for retaining flowable materials is provided. Flexible materials are attached together at portions thereof to form a body for retaining flowable material. An opening is provided to selectively allow passage of the flowable material therethrough. The closure device further comprises a slit through the body and a foldable neck between the body and the opening. The neck has a length sufficient to allow the opening to be inserted through the slit, thereby effecting closure of the retainer.

According to another embodiment of the invention a recloseable flexible retainer is provided. Flexible materials are sealed together at peripheral portions thereof to form a retainer body. The retainer further comprises a mouth for receiving a product therethrough and a neck between the mouth and the body. Closure of the retainer is effected by folding the neck over and tucking the mouth into a slit through the retainer body. The slit is generally parallel to the intersection of the neck with the body and has a length greater than the width of the neck but less than the width of said mouth.

It is an advantage of the present invention that a closure device and method are provided for sealably closing a body retaining flowable materials wherein a clamping force, to prevent material flow through the device, increases as material flows towards the closure. It is a further advantage of the present invention that a closure device is provided which is simple and inexpensive to produce yet is capable of retaining a broad range of flowable materials.

DETAILED DESCRIPTION OF THE INVENTION

Various embodiments of closure devices in accordance with the present invention are shown in FIGS. 1-4. Although the closure device is shown in the FIGURES being used in connection with a container, it is to be understood that the closure device may be employed in many applications and it is not intended that the invention be limited to any particular applications. For example, the closure device may be used in connection with plasma bags, colostomy bags, canteens, conduits, packages, or other retainers. Thus, it will be understood that the closure device may be employed in retainers having a plurality of openings wherein the device is employed to selectively close at least one of the openings. In addition, al the closure device of the illustrations is integrally formed with the container, in practice the closure device may be constructed separately and interconnected with a retainer.

Figure 2:
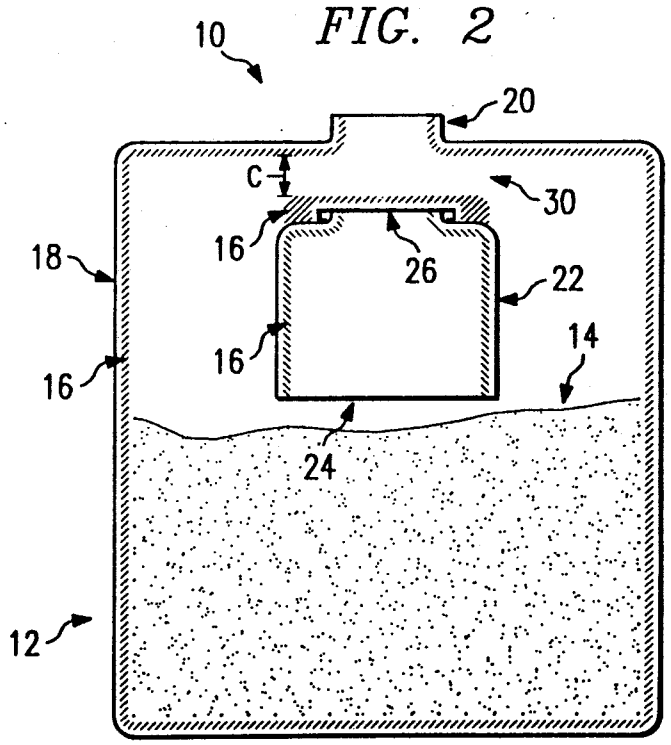
FIG. 2 is a front elevational view of the retainer shown in FIG. 1 with the closure device shown in a closed position.
Figure 1:
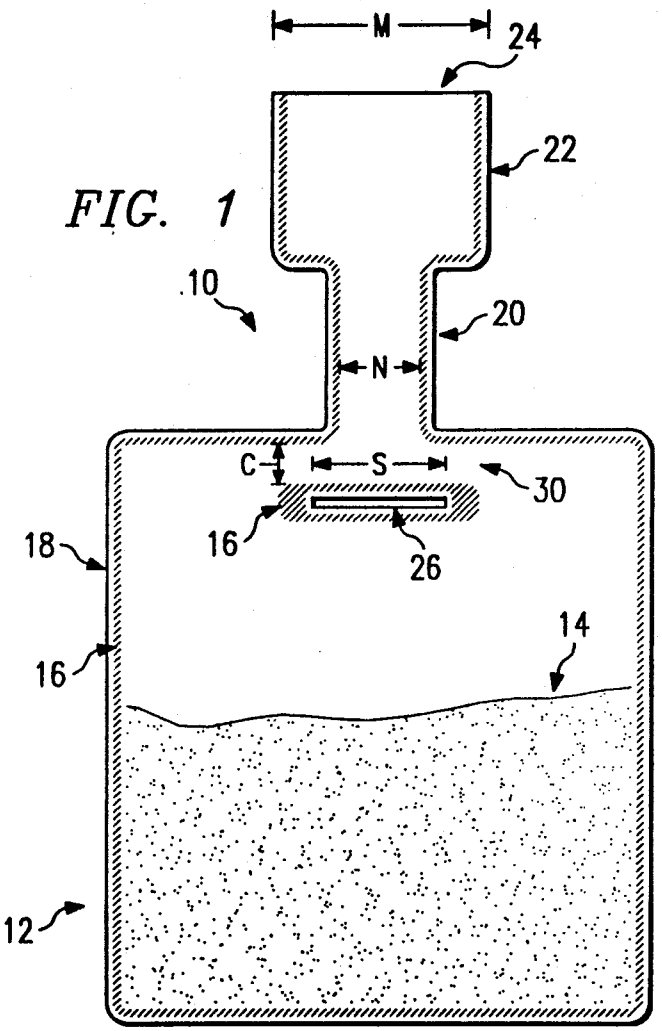
FIG. 1 is a front elevational view of a retainer having a closure device constructed in accordance with an embodiment of the present invention shown in an open position.

Referring to FIGS. 1 and 2, front elevational views of a closure device, generally identified by the reference numeral 10, constructed in accordance with an embodiment of the present invention are shown. The device 10 is shown in an open (FIG. 1) and closed (FIG. 2) position. In the illustrated embodiment, the closure device 10 is used in connection with a retainer 12, for example, a container, holding a flowable material 14. The material 14 may comprise, for example, a fluid, powder, semi-fluid or other flowable material.

The retainer 12 comprises flexible materials attached together at peripheral portions thereof, identified by the shaded areas 16, to form two walls of a body 18 for retaining the flowable material 14. Preferably, the flexible material comprises sheets (or one folded sheet) of a heat sealable polymeric material, such as urethane, so that the sheets may be attached together at selected portions 16 by a simple heat sealing process. Alternatively, the flexible material may be initially formed in the desired configuration, thus eliminating the need for separate sealing steps. An open end 24 is provided to allow passage of the flowable material 14 into or out of the body 18 when the closure device 10 is in the open position. The closure device 10 further comprises a foldable neck 20 and mouth 22 between the body 18 and open end 24. For reasons which will be more fully understood from the description below, the neck 20 and mouth 22 are formed from flexible materials so that they can be unfolded and folded when the closure device 10 is opened and closed. Preferably, the neck 20 and mouth 22 are formed from the same flexible materials used to form the body 18 for ease of construction.

The closure device 10 further comprises a slit 26 extending through the body 18 penetrating both walls of the body 18. Typically, the flexible materials are attached together, for example by heat sealing, at areas 16 surrounding the slit 26 to prevent the flowable material 14 from escaping through the slit 26. The slit 26 is oriented so that its longitudinal axis is generally parallel to the intersection of the neck 20 and the body 18, and perpendicular to the longitudinal axis of the neck 20. In addition, the slit 26 is positioned to define a channel 30 of width C between the slit 26 and the neck 20.

The neck 20 has a length sufficient to allow the mouth 22 and open end 24 to be inserted through the slit 26 when the neck 20 is folded about the channel 30 to close the closure device 10. The neck 20 also has a width N less than the length S of the slit 26. Preferably, the width N of the neck 20 is about twice the width C of the channel 30.

A means for securing is provided to secure the open end 24 after the open end 24 has been inserted through the slit 26, thereby maintaining the closure device 10 in the closed position. The means for securing may comprise, for example, an adhesive or hook and loop material such as Velcro TM, to removably attach a portion of the neck 20 or mouth 22 to a wall of the body 18. In the illustrated embodiment, the means for securing comprises a wide mouth 22 having a width M greater than the length S of the slit. The mouth 22 is foldable to allow insertion of the mouth 22 through the slit 26 but unfolds after insertion to secure the closure device 10 in the closed position.

In practice, when the closure device 10 is open as shown in FIG. 1, the flowable material 14 can flow from the body 18 about the slit 26, through the neck 20 and mouth 22, and out the open end 24. Of course, flowable material 14 can also be added to the body 18 by the reverse route. The device 10 is closed by folding the neck 20 about the channel 30 and tucking the mouth 22 and open end 24 through the slit 26 as shown in FIG. 2. When the open end 24 is inserted through the slit 26 the device 10 is sealably closed thereby substantially preventing passage of the flowable material 14 through the neck 20 between the body 18 and the open end 24. To increase the ability of the device 10 to prevent passage of the flowable material 14 through the neck 20, the open end 24 may be inserted through the slit 26 and wrapped around the channel 30 one or more times before securing the open end 24 in the slit 26. It will be understood that the length of the neck 20 may be varied according to the number of such wrapping procedures desired by the user.

Figure 3:
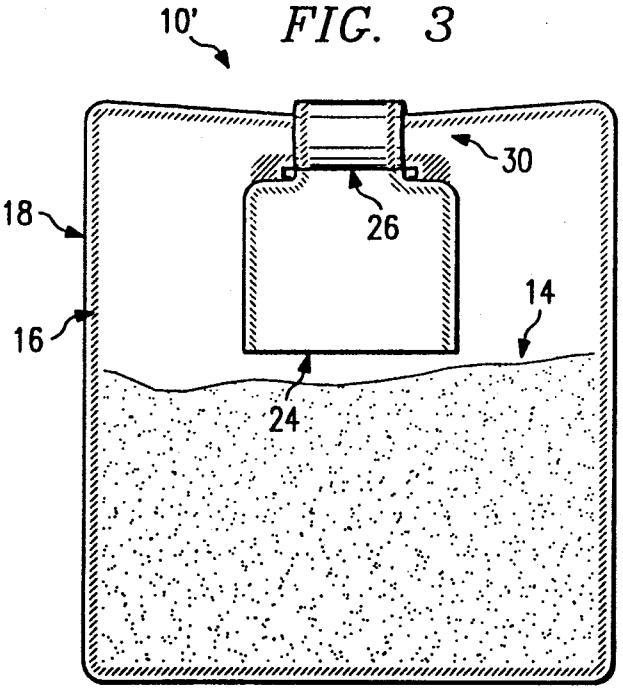
FIG. 3 is a front elevational view of an alternative embodiment of a retainer having a closure device of the present invention shown in a closed position.

Referring to FIG. 3, a front elevational view of an alternative embodiment of a closure device of the present invention, generally identified by the reference numeral 10', is shown in a closed position. The device 10' is closed by inserting the open end 24 through the slit 26, wrapping the open end 24 around the channel 30, and securing the open end 24 through the slit 26. The open end 24 may be wrapped around the channel 30 any number of times before being secured through the slit 26.

Figure 4:
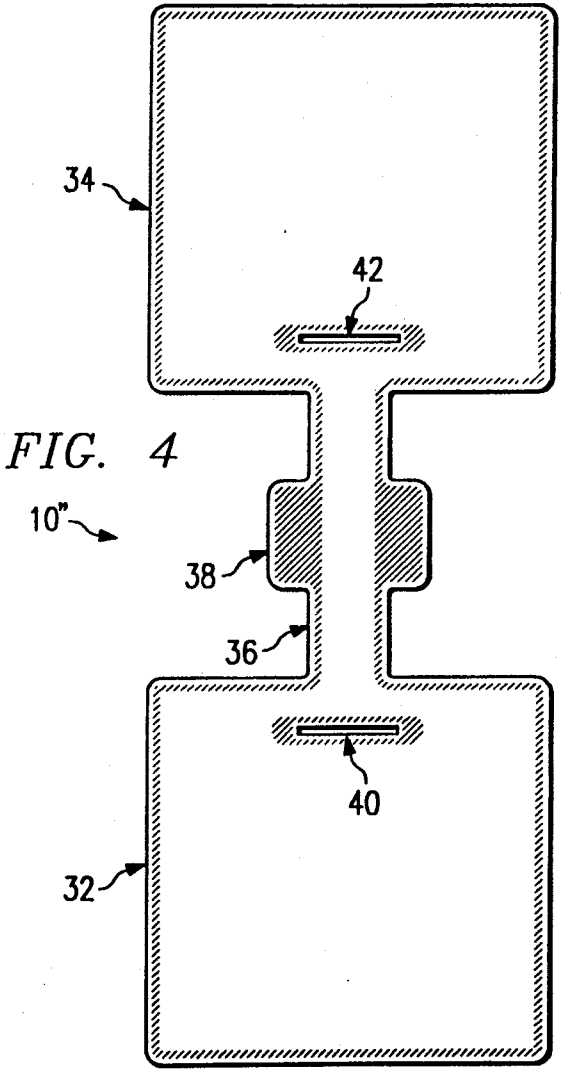
FIG. 4 is a front elevational view of a further alternative embodiment of a retainer having a closure device of the present invention shown in an open position.

Referring to FIG. 4, a front elevational view of a further alternative embodiment of a closure device of the present invention, generally identified by the reference numeral 10", is shown in an open position. The device 10" comprises a first retainer body 32 and a second retainer body 34 interconnected by a neck 36 which includes a wide mouth 38. The device 10" is closed by folding the neck 36 so that the first body 32 and second body 34 are aligned in a side-by-side relationship, and inserting the mouth 38 through a slit 40 in the first body 32 and a slit 42 in the second body 34. The device 10" may be used, for example, to store components of a mix until combination is desired.

By way of illustration, the components of a mixable product, such as an adhesive resin, can be stored in the first body 32 and the second body 34 with the device 10" in a closed position. Combination of the components may be accomplished by opening the device 10" and mixing the components in the first body 32 with the components in the second body 34. The mixed product can then be applied by cutting though a portion of the neck 36, first body 32 or second body 34 to provide an opening. Alternatively, the product may be applied through an opening provided at the mouth 38, or through an opening located elsewhere and provided with a suitable closure. Although not illustrated, it is noted that the device 10" may have more than two retainer bodies, successive bodies being linked by additional necks so that the device may be folded in a daisy-chain fashion.

The closure device has a number of advantages over prior art closure devices. Initially it is noted that the walls of the neck are urged together, thereby inhibiting passage of the flowable material therethrough, when the flowable material flows towards the neck and the device is in the closed position. The material flowing towards the neck causes the channel to expand or circularize resulting in a clamping force on a portion of the neck 20 wrapped thereabout. The clamping force serves to counteract the expansion forces associated with flow towards the closure which impairs the ability of prior art devices to provide a sealed closure. In addition, the clamping force exerted on the neck may be increased by simply increasing the number of wraps of the neck about the channel. In this manner, a reliable closure can be provided for critical and difficult applications such as retaining plasma or gases. Finally, the closure device may be simply and inexpensively constructed from flexible materials. The device is therefore economical and suitable for applications where it is desirable to dispose of the retainer after use.

While various embodiments of the present invention have been described in detail, it is apparent that further modifications and adaptations of the invention will occur to those skilled in the art. However, it is to be expressly understood that such modifications and adaptations are within the spirit and scope of the present invention.

What is claimed:

1. A closure device, comprising:
(a) flexible material in the form of at least one body for retaining flowable material, the body including a first wall and a second wall;
(b) an opening for selectively allowing passage of said flowable material therethrough;
(c) a slit extending through said body wherein portions of said first and second walls surrounding said slit are sealably interconnected to define said slit through the body; and
(d) a neck between said body and an end defining said opening, the neck being foldable so as to allow said opening to be inserted through said slit.

2. The closure device of claim 1, wherein said neck is formed from said flexible material.

3. The closure device of claim 1, wherein said flexible material comprises urethane.

4. The closure device of claim 1, wherein said flexible material is sealed at selected areas by heat sealing.

5. The closure device of claim 1, wherein said slit is positioned to define a passageway between said slit and said neck.

6. The closure device of claim 1, wherein a longitudinal axis of said slit is generally perpendicular to a longitudinal axis of said neck.

7. The closure device of claim 1, wherein said flexible material is heat sealed together around said slit to prevent the flowable material from escaping therethrough.

8. The closure device of claim 1, wherein the width of said neck is less than the length of said slit.

9. The closure device of claim 1, wherein said neck is foldable to allow said opening to be inserted through said slit, wrapped around a portion of said body between said slit and said neck, and inserted through said slit a second time.

10. The closure device of claim 1, wherein the width of said neck is approximately twice the width of a portion of said body between said slit and said neck.

11. The closure device of claim 1, further comprising means for securing said opening after said opening is inserted through said slit.

12. The closure device of claim 11, wherein said means for securing comprises a wide mouth between said neck and said opening, said mouth having a width greater than the length of said slit and being reversibly foldable to allow said mouth to be inserted through said slit and to secure said mouth.

13. The closure device of claim 1, wherein passage of said flowable material from said body to said opening is substantially prevented when said opening is inserted through said slit.

14. The closure device of claim 1, wherein said flowable material comprises a fluid.

15. The closure device of claim 14, wherein said fluid comprises a liquid.

16. The closure device of claim 1, wherein said opening comprises an open end of a retainer.

17. A recloseable flexible retainer, comprising:
(a) first and second sheets of flexible material sealed at peripheral portions thereof to form a retainer body;
(b) a mouth having an opening for receiving a product;
(c) a neck between said body and an end defining said mouth; and
(d) a slit extending through said first and second sheets, portions of said first and second sheets surrounding said slit being sealed together to define said slit through the body, the slit being generally parallel to the intersection of said neck and said body and having a length greater than the width of said neck and less than the width of said mouth, wherein closure of said container is effected by bending said neck and tucking said mouth through said slit.

18. The retainer of claim 17, wherein said product comprises a fluid, passage of said fluid through said neck being substantially prevented when said mouth is tucked through said slit.

19. A method for closing an opening of a flexible retainer, comprising the steps of:
(a) providing a flexible retainer body defined by a first wall and a second wall, the body having a continuous slit extending through the first and second walls;

(b) providing a foldable neck with an end defining said opening and extending from said retainer body, and (c) folding said neck and inserting said opening through said slit.

20. The method of claim 19, further comprising the steps of:

providing a mouth between said opening and said neck, the mouth having a width greater than the length of said slit; and tucking said mouth through said slit to secure the opening through said slit.

21. The method of claim 19, further comprising the steps of:

wrapping said neck at least once around a portion of the retainer body between said slit and said neck after said opening has been inserted through said slit; and inserting said opening through said slit at least a second time.

22. A method for preventing escape of a flowable material from a retainer, comprising the steps of:

(a) providing a closure device comprising flexible material in the form of at least one body for retaining flowable material, the body including a first wall and a second wall, an opening for selectively allowing passage of said flowable material therethrough, a slit extending through said body wherein portions of said first and second walls surrounding said slit are sealably interconnected to define said slit through the body, and a neck between said body and an end defining said opening; and (b) inserting said opening through said body thereby preventing passage of said flowable material from said body to said opening.

23. The method of claim 22, comprising the steps of:

folding said neck to insert said opening through said body, wherein a portion of said body expands when flowable material flows towards said neck to resist passage of flowable material through the neck.

* * * * *

UNITED STATES PATENT AND TRADEMARK OFFICE

CERTIFICATE OF CORRECTION

PATENT NO. : 5,199,602

DATED : April 6, 1993

INVENTOR(S) : Drew

It is certified that error appears in the above-identified patent and that said Letters Patent is hereby corrected as shown below:

Column 3, line 32, please delete "al" and insert therefor -- although --.

Claim 23, column 8, line 20, please insert -- thereby exerting a clamping force on said neck -- between the words "neck" and "to".

Signed and Sealed this

Thirtieth Day of November, 1993

*Attest:*

*Attesting Officer*

BRUCE LEHMAN

*Commissioner of Patents and Trademarks*